United States Patent [19]

Westell

[11] 4,415,161

[45] Nov. 15, 1983

[54] GAME BOARD

[76] Inventor: David A. Westell, Box 69792, Station K, Vancouver, B.C., Canada

[21] Appl. No.: 270,572

[22] Filed: Jun. 4, 1981

[51] Int. Cl.[3] ..... A63F 3/00

[52] U.S. Cl. ..... 273/285; 273/284

[58] Field of Search ..... 273/285, 286, 287, 265, 273/284; 46/1 L, 35–37

[56] References Cited

U.S. PATENT DOCUMENTS

| | | | |
|---|---|---|---|
| 415,371 | 11/1889 | Smith | 273/284 X |
| 1,686,834 | 10/1928 | Nickerson | 229/16 R X |
| 1,723,377 | 8/1929 | Salomon | 273/274 X |
| 3,116,927 | 1/1964 | Kuhlman | 273/272 |
| 3,165,318 | 1/1965 | Lissandrello | 273/272 |
| 3,503,612 | 3/1970 | Singer | 273/272 |
| 3,899,176 | 8/1975 | Gregan | 273/236 X |
| 4,371,169 | 2/1983 | Compton | 273/271 |

FOREIGN PATENT DOCUMENTS

| | | | |
|---|---|---|---|
| 201550 | 12/1923 | United Kingdom | 273/285 |

*Primary Examiner*—Richard C. Pinkham
*Assistant Examiner*—Scott L. Brown
*Attorney, Agent, or Firm*—Westell & Hanley

[57] ABSTRACT

A game board assembly provides a central column designed to stand upwardly on a horizontal surface. Three or four playing boards are connected to the base of said column and extend outwardly from the base in directions which are approximately equally angularly spaced. The column is made from panels hinged together and the playing boards are hinged to the base of the panels. The entire assembly is capable of being folded into a stack when not in use and a four player or a three player game as desired.

6 Claims, 12 Drawing Figures

FIG. 1
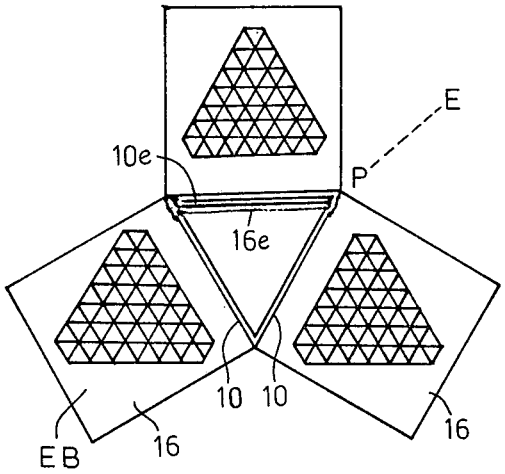
FIG. 3
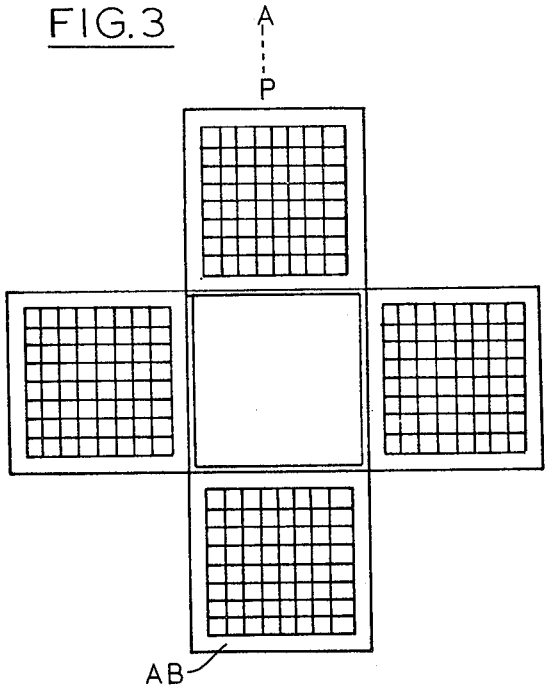
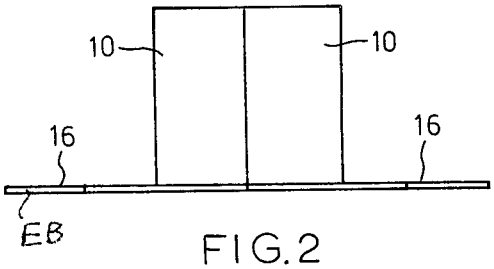
FIG. 2
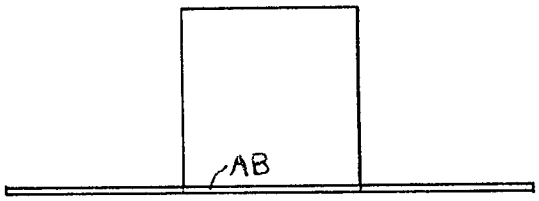
FIG. 4
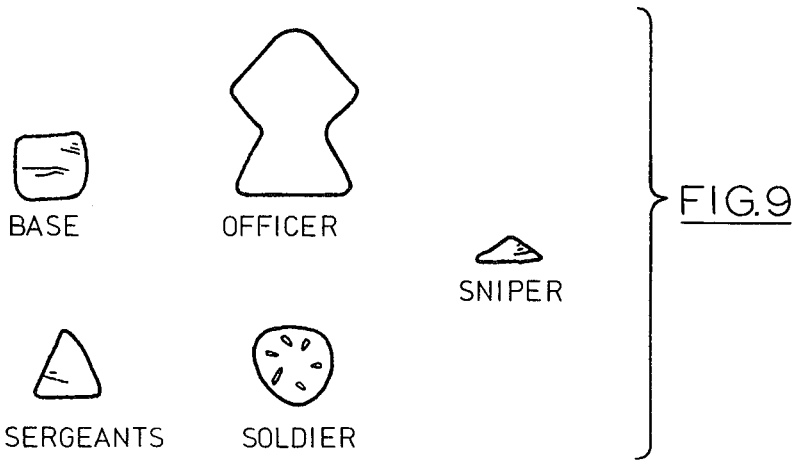
FIG. 9

GAME BOARD

This invention relates to a game board assembly.

No search of the prior art has been performed but the most relevant prior art known to the applicant is (a) the game of Kriegspiel where a vertical panel separates two chess boards on which two players move on their own boards, each without knowledge of the position of the opponent's men and being prevented from making moves which are illegal by a referee who can see both boards and (b) the game known as "Sink the Swiss Navy" or "Battleship" (Trade Mark) where two players each with playing grids invisible to the other attempt to locate the opponent's playing pieces.

It is an object of this invention to provide a playing board assembly comprising a central column designed to project upwardly from a horizontal surface (such as a table) and three or more playing boards connected to and radiating outwardly from the central column in approximately equiangularly spaced radial directions thereabout. The height and width of the column is chosen relative to the dimensions of the playing boards so that for players (the number of players will normally correspond to the number of boards) in normal playing attitudes (e.g. sitting at the table) at least one of the playing boards is obscured to each player by the central column. Thus if a part of the "play" is taking place on each of the playing boards, each player must play with some but not all of the information.

A very large number of games may be devised for playing with such an assembly, the game and the rules determining the playing pieces and the design of the board. It is contemplated that in many of such games the each playing board will be similar to the other and all will be similarly aligned so that they may be considered (figuratively) as superimposed. The description of the specific embodiment herein is followed by the rules for two of such games using, respectively (1) four playing boards radiating at 90° to each other from the upstanding column and (2) three playing boards radiating at 120° to each other from the upstanding column.

It is also an object of the invention to provide a board assembly comprising a plurality of hingedly connected panels which on the one hand may be errected in alternative arrangements to provide either a three person or a four person game and, (preferably) on the other hand, may be folded into a compact stack when not in use.

Figure 5A:
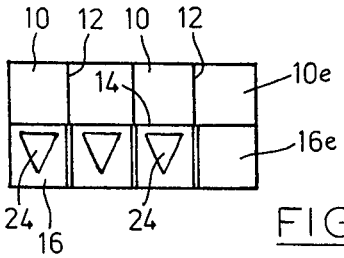
Figure 6A:
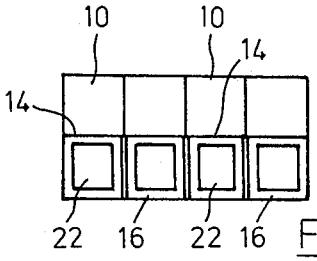
Figure 5B:
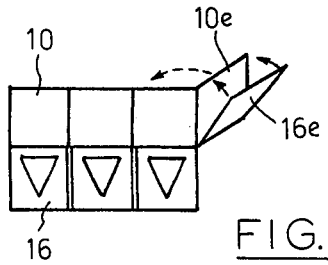
Figure 6B:
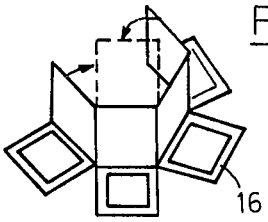
Figure 7:
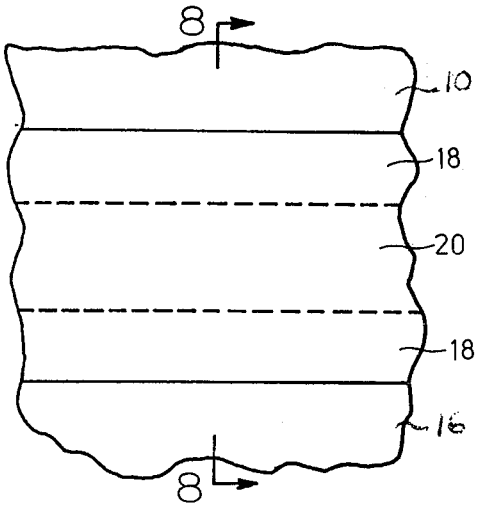
Figure 8:
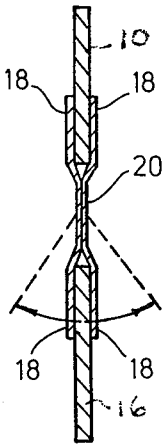

In drawings which illustrate preferred embodiments of the invention:

FIG. 1 is a plan view of a game board assembly in accord with the invention arranged to provide 3 playing boards, FIG. 2 is a side view of the arrangement of FIG. 1, FIG. 3 is a plan view of the same game board assembly as shown in FIG. 1 but arranged in accord with the invention having 4 playing surfaces, FIG. 4 is a side view of the arrangement of FIG. 3, FIG. 5A shows, schematically, one side of a blank for making the arrangements of FIGS. 1–4, FIGS. 5B and 5C show, schematically, the method of folding the blank to provide the arrangement of FIGS. 1 and 2, FIG. 6A shows schematically the other side of the blank of FIG. 5A, FIG. 6B shows the folding of the blank in the attitude of FIG. 6A to provide the arrangement of FIGS. 3 and 4, FIG. 7 is a detailed view showing the connection of panels of the blank, FIG. 8 is a section along the lines 8—8 of FIG. 7; and FIG. 9 shows an example of a set of men for use with such playing boards.

In the drawings FIGS. 5A and 6A show, schematically, a preferred form of a blank form which the assembly may be formed. The blank preferably comprises four preferably rectilinear panels 10 of equal width (and preferably square) with each panel hinged at its side edge 12 to an adjacent panel, and the end panels in the row thus formed having one free side edge and one hinged side edge 12. Hinged to the bottom edge 14 of each panel 10 is a playing board panel 16 preferably of the same width as the vertical panel. The panels 10 and 16 are preferably formed of corrigated cardboard. For dual use such as described hereafter and for compact storing of the game when not in use, it is desirable that the hinging at edges 12 and 14 allow swinging of the playing board panels swung in either direction relative to the panels 10. A preferred method of achieving such hinging is demonstrated in FIGS. 7 and 8. As shown a tape, preferably a pressure sensitive binding tape 18 is attached to connect panels 10 and 16 on each side of the panels. Each tape overlaps a strip of each panel it joins but has a short central extent 20, between the panels which is pressed against the similar extent of the counterpart tape. This is schematically illustrated in FIG. 8. The extent of double thickness tape 18, which tape is quite flexible, supplies a convenient hinge so that the playing board panel may be conveniently, and repeatedly, swung in either direction thereabout. Similar hinging is preferably used between the side edges of the attached panels 10.

As shown, the blank with its hinged panels is provided (FIG. 6A) with square playing boards 22 on the same side of each panel 16 and (FIG. 5A) with equilateral three sided playing boards 24 on the opposite side of three panels 16 (omitting one end panel **16*e***).

As illustrated in FIGS. 6A and 6B the blank may be folded to provide the four sided playing board of FIGS. 3 and 4, and in this attitude erected on a playing surface such as a table may be used for any number of four player games.

Figure 5C:
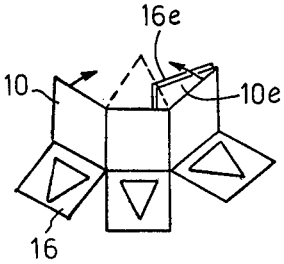

As illustrated in FIGS. 5A, 5B, 5C the blank may be folded to provide the three sided playing board of FIGS. 1 and 2, and in this attitude erected on a playing surface such as a table, may be used for any number of three player games.

Examples of specific rules for playing a four player game and a three player game follow hereafter. However, before setting these out, it is desired to discuss broader facets of the invention.

The invention provides a playing board assembly wherein 3 or 4 playing boards radiating at equiangular spacing from a central pillar. With the 3 or 4 playing boards radiating at equiangular spacing, the central pillar is dimensioned so that, for each player, in a normal playing attitude (e.g. seated at a table on which the playing board assembly is erected), one of the playing boards, located opposite him is obscured. Thus, looking at FIGS. 3 and 4, (assuming the panels are square) to a player sitting at along radial axis AP from the central pillar the playing board AB will be obscured to player A looking down over the central pillar at an angle below the horizontal of 45° or less. The same is true for the three man game of FIGS. 1 and 2 so that to a player located along the radial axis EP the playing board EB will be obscured unless the player located on EB is looking down over the board at depression angles of greater than 45°. The boards and the panels need not be square. The 45° limitation will apply if no part of the active portion of the playing board is farther from the pillar than its effective height. Thus the invention preferably, and for most games, will obscure the active portions of a playing board to a player located opposite thereto looking down at a depression angle of less than 45°. For some games the pillar may be shorter relative to the horizontal projection of the board therefrom, reducing obscurity of the opposite board to a depression angle of less than 45°.

With each game each of the players will play whatever game is involved with the information obtained from observation of one less than the total number of boards. For most games all the boards will be considered as conceptually superimposed and involve the rule that if a player makes an illegal move due to his ignorance of playing pieces on the opposite board (non-visible to him), another player must so inform him. For these two reasons it is desireable that all boards have the same orientation. Thus the four man games will most suitably be used in a square or rectilinear orientation while the three man games will most suitably be those played on boards having axes of symmetry at 120° to each other so that (as shown in FIG. 1) the all playing boards will have the same orientation.

The playing pieces of FIG. 9 are exemplary only and are described in connection with the exemplary games now described.

EXEMPLARY GAMES

The games described herein are strategic games for four and three players respectively. In the four way game, pairs of players play in teams (although games may easily be provided where the players play independently) while in the three way game described, each player plays independently.

While the number of playing boards corresponds to the number of players, these boards are considered as conceptually superimposed. While playing, the players must attempt to picture the boards combined by superposition into an imaginary board, the map.

The four-way game is for two sets of partners.

In the four-way game, the game board is arranged so that the four square playing boards protrude from a square column as in FIGS. 3 and 4.

Only the two different coloured sets of pieces of the type of FIG. 9 are used. Each set should consist of one base, one officer, two sergeants, two corporals, two soldiers and one sniper.

Players arrange themselves around the game so that each has his own playing board. Each player can see the boards on his right and left, but not the one opposite. Two possible arrangements exist:

(a) each player can see his partner's board, but only one of his opponents' boards;

(b) each player can see both his opponent's boards, but not his partner's.

Although each player moves his own pieces around his own board, the four boards are imagined to be superimposed on a *map;* each square is considered to be the same as its corresponding squares on the other boards, and any piece on any board is considered to be present on all four boards. If desired the squares may be numbered to assist in finding corresponding squares on different boards.

STARTING:

(1) Each team takes a set of pieces and divides them in any way; this division must be kept secret from the other team until movement begins. Each players now has a number of pieces under his own command.

(2) Each player chooses a corner of the *map* from which to start. No two players may start from the same corner. (A player's starting corner may be either adjacent or diagonally opposite his partner's).

(3) Each player then arrange his pieces on his own board within the boundary of the corner he has chosen. While setting up the pieces, no player may look at another player's arrangement.

(4) After the pieces are on the board, a coin is tossed to see which team moves first. The team losing the toss then chooses which player of the winning team moves first.

MOVEMENT:

(5) After the first move, the other players move in clockwise succession.

(6) A player's move obliges that player to move one piece to the right, left, forward or backward. A piece may not move diagonally. A player may not pass.

(7) No two pieces may occupy the same square at the same time.

When (in a game in which players cannot see their partner's boards) a player accidentally moves his piece onto a square occupied by his partner's piece, the player who has made the move must be told to take his move back. He may not be told which piece already occupies the square, nor may his partner be told which piece has attempted to move onto the square. The player takes his move back and attempts another move.

When a player moves his piece onto a square occupied by an enemby piece, there is a capture (see "Capture").

CAPTURE:

(8) A capture occurs when a player moves his piece onto a square occupied by an enemy piece. Four types of capture exist:

(i) when a sniper and an officer meet, the sniper remains and the officer is removed;

(ii) when a base and any other piece meet, the base is removed (see "End of game");

(iii) when two pieces the same size meet, they are both removed;

(iv) in any other case, the larger piece remains and the smaller piece is removed.

A base may never meet the opposing base. When (in a game in which the two bases are on opposite boards) a player accidentally moves his base onto the square occupied by the opposing base, the player who has made the move must be told to take his move back. The player takes his move back and attempts another move.

(9) If a player captures a piece he cannot see, the other players are obliged to remove the piece for him. All players must be made aware of the circumstances of *any* capture: where the capture has been made, which piece has been removed, and which piece remains on the square.

SECRECY:

(10) Except for the cases stated for captures and illegal moves, no player may give information or advice, make demands, or communicate in any way positions or movement to any other player.

END OF GAME: (11) The team wins that captures the other's base.

RULES OF THREE-WAY GAME

In the three-way game, the game board is arranged so that the three triangular playing boards protrude from a triangular column (the superfluous panels being tucked inside the column). This is illustrated in FIGS. 5A–5C, 1 and 2.

Sets of the men of FIG. 9 in three colors are used, but not all the pieces. Each set consists of one base, one officer, one sergeant, one corporal, two soldiers and one sniper.

In the three-way, each player, playing independently, sits aligned with a corner of the column and between two boards; each player uses both of the boards that he can see while one board remains obscured.

The three boards in the three-way game are imagined to be superimposed on a map; each triangle is considered to be the same as its corresponding triangles on the other two boards, and any piece on any broad is considered to be present on all three boards.

STARTING:

(1) The first moves of the game entail placing the pieces on the boards. During the initial moves of the game, each player may distribute his pieces between the two boards in front of him; after a piece is on the board, though, it may be be moved from one board to the other.

(2) The first player to move claims a corner of the *map* by placing any piece within any space within that corner. The other players do the same in clockwise succession. The players then place the rest of their pieces in their respective corners one at a time in clockwise succession.

No two players may claim the same starting corner. If a player accidentally claims a starting corner already claimed by another player, the other players must inform him; the player then takes his move back and attempts to claim another corner.

MOVEMENT:

(3) After all the pieces have been placed on the board, a player's move obliges that player to move one piece from one space to an adjacent space (from one triangle to another which shares the same side). A piece may not move across a corner. A player may not pass.

(4) No two pieces may occupy the same space at the same time. If a player moves his piece onto a space occupied by another player's piece, there is a capture (see "Capture").

CAPTURE:

(5) A capture occurs when a player moves his piece onto a space occupied by an opponent's piece. Four types of capture exist:

(i) if a sniper and an officer meet, the officer is removed and the sniper remains;

(ii) if a base and any other piece meet, the base is removed (see "End of game");

(iii) if two pieces the same size meet, they are both removed;

(iv) in any other case, the smaller piece is removed and the larger one remains.

A *base* may never meet another *base;* if a player moves his *base* onto a space occupied by the *base* of another player, the other players must inform him; the player then takes his move back and attempts another move.

If a player captures a piece he cannot see, the other players must remove the captured piece for him. All players must be made aware of the circumstances of any capture: where the capture has been made, which piece has been removed, and which piece remains on the space.

SECRECY:

(6) Except for the cases stated for captures and illegal moves, no player may give information or advice, make demands, or communicate in any way positions or movement to any other player.

END OF GAME:

(7) A player is eliminated from the game when his *base* is captured.

The player who has made the capture, the "captor", retains all of the pieces (except the base) of the eliminated player, the "captive", in the following manner: the captive's *base* is removed; all the captive's pieces that the captor *cannot* see are transferred to the board shared between the captor and the other remaining player; the transferred pieces, retaining the positions they had on the original board as well as the captive's pieces that the captor can see, become part of the captor's set for use against the other remaining player.

The player wins who remains in the game after the other two players have been eliminated.

The first player to be eliminated should remain where he is seated until the end of the game so that he can point out captures and illegal moves.

I claim:

1. Game board assembly comprising:

a central column designed to stand upwardly on a horizontal surface, not less than three and not more than four playing board panels designed to rest on said playing surface, said playing board panels being connected to said column to extend outwardly therefrom, the directions of horizontal extension of said playing board panels being approximately equally spaced about said column, a playing board delineated on each of said playing board panels, said playing boards being substantially identical to each other, wherein the dimensions of said column and the dimensions of said playing boards and the playing board location on each said playing board panel are such that each playing board is obscured by said column to a person seated at the horizontal surface and located in the opposite direction from said column to the playing board, wherein three playing boards are provided each extending from said column at substantially 120° intervals to the next.

2. Game board assembly comprising:

a central column designed to stand upwardly on a horizontal surface, not less than three and not more than four playing board panels designed to rest on said playing surface, said playing board panels being connected to said column to extend outwardly therefrom, the directions of horizontal extension of said playing board panels being approximately equally spaced about said column, a playing board delineated on said playing board panels, said playing boards are substantially identical to each other, wherein the dimensions of said column and the dimensions of said playing boards and the playing board location on each said playing board panel are such that each playing board is obscured by said column to a person looking from the opposite side of said column and downward at an angle to the vertical of 45° or less, wherein three playing boards are provided each extending from said column at substantially 120° intervals to the next.

3. Game board assembly comprising:

a central column designed to stand upwardly on a horizontal surface, not less than three and not more than four playing board panels designed to rest on said playing surface, said playing board panels being connected to said column to extend outwardly therefrom, the directions of horizontal extension of said playing board panels being approximately equally spaced about said column, a playing board delineated on each of said playing board panels, said playing boards being substantially identical to each other, wherein the dimensions of said column and the dimensions of said playing boards and the playing board location on each said playing board panel are such that each playing board is obscured by said column to a person seated at the horizontal surface and located in the opposite direction from said column to the playing board, wherein said column is composed of substantially similar rectilinear panels hinged to each other on side edges as defined by the erected attitude of the column and said playing boards are each hinged to a respective bottom edge of one of said rectilinear panels.

4. Game board assembly comprising:

a central column designed to stand upwardly on a horizontal surface, not less than three and not more than four playing board panels designed to rest on said playing surface, said playing board panels being connected to said column to extend outwardly therefrom, the directions of horizontal extension of said playing board panels being approximately equally spaced about said column, a playing board delineated on said playing board panels, said playing boards are substantially identical to each other, wherein the dimensions of said column and the dimensions of said playing boards and the playing board location on each said playing board panel are such that each playing board is obscured by said column to a person looking from the opposite side of said column and downward at an angle to the vertical of 45° or less, wherein said column is composed of substantially similar rectilinear panels hinged to each other on side edges as defined by the erected attitude of the column and said playing boards are each hinged to a respective bottom edge of one of said rectilinear panels.

5. Game board assembly comprising:

a central column designed to stand upwardly on a horizontal surface, not less than three and not more than four playing board panels designed to rest on said playing surface, said playing board panels being connected to said column to extend outwardly therefrom, the directions of horizontal extension of said playing board panels being approximately equally spaced about said column, a playing board delineated on each of said playing board panels, said playing boards being substantially identical to each other, wherein the dimensions of said column and the dimensions of said playing boards and the playing board location on each said playing board panel are such that each playing board is obscured by said column to a person seated at the horizontal surface and located in the opposite direction from said column to the playing board, wherein said column is composed of four substantially similar rectilinear panels hinged to each other on side edges as defined by the erected attitude of the column and so that there are two end panels with one hinged side edge, and said playing board panels are each hinged to a respective bottom edge of one of said rectilinear panels, wherein said playing board panels are each hinged to swing from an orientation perpendicular to its attached column panel in one sense to an orientation perpendicular to its attached column in the opposite sense.

6. Game board assembly comprising:

a central column designed to stand upwardly on a horizontal surface, not less than three and not more than four playing board panels designed to rest on said playing surface, said playing board panels being connected to said column to extend outwardly therefrom, the directions of horizontal extension of said playing board panels being approximately equally spaced about said column, a playing board delineated on said playing board panels, said playing boards are substantially identical to each other, wherein the dimensions of said column and the dimensions of said playing boards and the playing board location on each said playing board panel are such that each playing board is obscured by said column to a person looking from the opposite side of said column and downward at an angle to the vertical of 45° or less, wherein said column is composed of four substantially similar rectilinear panels hinged to each other on side edges as defined by the erected attitude of the column and so that there are two end panels with one hinged side edge, and said playing board panels are each hinged to a respective bottom edge of one of said rectilinear panels, wherein said playing board panels are each hinged to swing from an orientation perpendicular to its attached column panel in one sense to an orientation perpendicular to its attached column panel in the opposite sense.

* * * * *